US005405878A

United States Patent [19]

Ellis et al.

[11] Patent Number: 5,405,878

[45] Date of Patent: Apr. 11, 1995

[54] CONTACT LENS SOLUTION CONTAINING CATIONIC GLYCOSIDE

[75] Inventors: Edward J. Ellis; Jeanne Y. Ellis, both of Lynnfield, Mass.

[73] Assignee: Wilmington Partners L.P., Wilmington, Mass.

[21] Appl. No.: 80,423

[22] Filed: Jun. 18, 1993

[51] Int. Cl.[6] ..... C11D 1/83

[52] U.S. Cl. ..... 422/28; 514/840; 514/839; 252/542; 252/547; 252/DIG. 7; 424/78.04

[58] Field of Search ..... 514/23, 459, 460, 839, 514/840; 424/78.38; 252/542, 547

[56] References Cited

U.S. PATENT DOCUMENTS

| | | | |
|---|---|---|---|
| 4,168,112 | 9/1979 | Ellis | 351/160 H |
| 4,321,261 | 3/1982 | Ellis | 424/180 |
| 4,436,730 | 3/1984 | Ellis | 424/180 |
| 4,775,424 | 10/1988 | Wisotzki et al. | 134/42 |
| 5,138,043 | 8/1992 | Polovsky et al. | 536/17.9 |

OTHER PUBLICATIONS

Patent Abstracts of Japan, vol. 013, No. 426 (P-935), Sep. 22, 1989 & JP,A,01 158 412 (Daicel Chem Ind Ltd), Jun. 21, 1989.

Database WPI, Section Ch, Week 8914, Derwent Publications, Ltd., London, GB; Class A96; AN 89-103364 & JP,A,1 050 014 (Tome Sangyo KK), Feb. 27, 1989.

*Primary Examiner*—Peter O'Sullivan
*Assistant Examiner*—B. Burn
*Attorney, Agent, or Firm*—John E. Thomas; Craig E. Larson

[57] ABSTRACT

Compositions for treating contact lenses, particularly rigid, gas permeable contact lenses, comprise a quaternary nitrogen-containing ethoxylated alkyl glucoside.

11 Claims, No Drawings

CONTACT LENS SOLUTION CONTAINING CATIONIC GLYCOSIDE

BACKGROUND OF THE INVENTION

This invention relates to compositions for treating contact lenses, especially rigid, gas permeable contact lenses.

The surfaces of contact lenses must have a certain degree of hydrophilicity to be wet by tears. Tear wettability is in turn necessary to provide the lens wearer with comfort and good vision.

One way to impart wettability to contact lens surfaces is to add hydrophilic monomers to the mixture of comonomers used to form the contact lens material. However, the relative amount of hydrophilic monomer added affects physical properties other than wettability. For example, the hydrophilic monomer content of rigid gas permeable lens materials is much less than that of soft, hydrogel lenses. The rigid lenses accordingly contain only a few percent water of hydration whereas soft lenses contain amounts varying from 10 to 90%. Thus, while hydrophilic monomer addition does increase wettability, the technique is limited by the influence that it has on other properties.

Another way to impart wettability to lens surfaces is to modify the surface after polymerization. For example, surface coatings of hydrophilic polymers have been grafted onto the surface. Plasma treatment has also been used to increase the hydrophilicity of hydrophobic surfaces. Although effective, methods such as these are often expensive (requiring complicated and difficult manufacturing procedures) and impermanent.

Water soluble polymers in lens care solutions have also been used to enhance the wettability of lens surfaces. Use of wetting polymers in this way provides a "cushion" between the lens and the eye which is equated with increased wettability as wearer comfort and tolerance. However, a common drawback with this approach is that the cushion layer dissipates rapidly, since there is little specific interaction between the polymer and the lens surface.

U.S. Pat. Nos. 4,168,112 and 4,321,261 disclose a method to overcome this drawback by immersing the lens in a solution of an oppositely charged ionic polymer to form a thin polyelectrolyte complex on the lens surface. The complex increases the hydrophilic character of the surface for a greater period of time relative to an untreated surface. Of particular interest are cellulosic polymers bearing a cationic charge, said polymers forming a strongly adhered hydrophilic layer on the contact lens surface. These polymers have proven to be exceptional components for wetting, soaking, and lubricating solutions.

Cationic surfactants greatly lower the surface tension of water and will accumulate on surfaces which have hydrophobic character. However, cationic surfactants are often not biocompatible with the eye. Some (i.e., benzalkonium chloride) are known to cause severe ocular reactions.

SUMMARY OF THE INVENTION

The invention provides aqueous compositions for treating contact lenses comprising a quaternary nitrogen-containing ethoxylated alkyl glucoside.

Additionally, the invention relates to methods employing the compositions.

DETAILED DESCRIPTION OF THE INVENTION

Representative quaternary nitrogen-containing ethoxylated alkyl glucosides useful in the practice of this invention are represented by Formula (I):

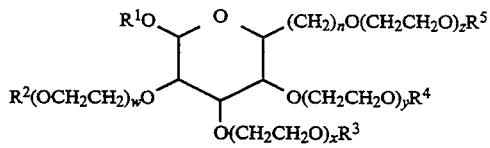

(I)

wherein $R^1$ is alkyl, preferably $C_1$–$C_{18}$ alkyl;

the average sum of w, x, y, and z per mole of compound is within the range of about 4 to about 200, and preferably within the range of about 4 to about 20;

n is 0 or 1; and $R^2$, $R^3$, $R^4$, and $R^5$ are individually hydrogen or quaternary nitrogen-containing groups;

provided that at least one $R^2$, $R^3$, $R^4$, or $R^5$ is a quaternary nitrogen-containing group and that at least one $R^2$, $R^3$, $R^4$, or $R^5$ is hydrogen.

Representative quaternary nitrogen-containing groups for $R^2$, $R^3$, $R^4$, or $R^5$ are represented by Formula (II):

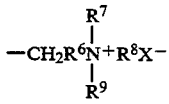

(II)

wherein $R^6$ is $C_{1-4}$ hydroxyalkylene; $R^7$, $R^8$, and $R^9$ are individually or combined as $C_{1-16}$ alkyl; and X is an anion, preferably a halide.

Especially preferred compounds of Formula (I) include compounds wherein $R^1$ is methyl, each of $R^2$, $R^3$ and $R^4$ is hydrogen, and $R^5$ is a quaternary nitrogen-containing group of Formula (II).

The quaternary nitrogen-containing ethoxylated glucosides are commercially available or can be prepared by methods known in the art, such as the methods described in U.S. Pat. No. 5,138,043 (Polovsky et al.).

An especially preferred material is quaternary nitrogen-containing ethoxylated glucose derivatives available under the CTFA (Cosmetic, Toiletry, and Fragance Association) designation lauryl methyl gluceth-10 hydroxypropyldimonium chloride, including the product commercially available under the tradename Glucquat-100® (Amerchol Corp., Edison, N.J.). GLUCQUAT-100 consists of a 10-mole ethoxylate of methyl glucoside and an ether-linked quaternized structure.

Applicants have found that the compositions of this invention are very effective at wetting the surfaces of contact lenses, especially rigid, gas permeable (RGP) contact lenses. The quaternary nitrogen-containing ethoxylated alkyl glucosides contain, in one portion of the molecule, a hydrophilic polyethoxylated alkyl glucoside derivative, and on another portion, a cationic, hydrophobic moiety attached to an ammonium ion. Due to the presence of the cationic moiety, the material can associate with negatively charged lens surfaces, whereby the hydrophilic moiety extends from the lens surface to maintain moisture on the surface. Additionally, this interaction with the lens imparts a "cushioning" effect to the lens surface to increase wearing comfort of lenses treated with the compositions.

The quaternary nitrogen-containing ethoxylated alkyl glucoside may be employed in the compositions at about 0.001 to about 10 weight percent of the composition, preferably at about 0.001 to about 5 weight percent, with about 0.005 to about 2 weight percent being especially preferred.

Typical compositions include buffering agents for buffering or adjusting pH of the composition, and/or tonicity adjusting agents for adjusting the tonicity of the composition. Representative buffering agents include: alkali metal salts such as potassium or sodium carbonates, acetates, borates, phosphates, citrates and hydroxides; and weak acids such as acetic, boric and phosphoric acids. Representative tonicity adjusting agents include: sodium and potassium chloride, and those materials listed as buffering agents. The tonicity agents may be employed in an amount effective to adjust the osmotic value of the final composition to a desired value. Generally, the buffering agents and/or tonicity adjusting agents may be included up to about 10 weight percent.

According to preferred embodiments, an antimicrobial agent is included in the composition in an antimicrobially effective amount, i.e., an amount which is effective to at least inhibit growth of microorganisms in the composition. Preferably, the composition can be used to disinfect a contact lens treated therewith. Various antimicrobial agents are known in the art as useful in contact lens solutions, including: chlorhexidine (1,1'-hexamethylene-bis[5-(p-chlorophenyl) biguanide]) or water soluble salts thereof, such as chlorhexidine gluconate; polyhexamethylene biguanide (a polymer of hexamethylene biguanide, also referred to as polyaminopropyl biguanide) or water-soluble salts thereof, such as the polyhexamethylene biguanide hydrochloride available under the trade name Cosmocil CQ (ICI Americas Inc.); benzalkonium chloride; and polymeric quaternary ammonium salts. When present, the antimicrobial agent may be included at 0.00001 to about 5 weight percent, depending on the specific agent.

The compositions may further include a sequestering agent (or chelating agent) which can be present up to about 2.0 weight percent. Examples of preferred sequestering agents include ethylenediaminetetraacetic acid (EDTA) and its salts, with the disodium salt (disodium edetate) being especially preferred.

The quaternary nitrogen-containing ethoxylated alkyl glucoside is very effective at providing the compositions with the ability to wet surfaces of contact lenses treated therewith. If desired, the composition may include as necessary a supplemental wetting agent. Representative wetting agents include: polyethylene oxide-containing materials; cellulosic materials such as cationic cellulosic polymers, hydroxypropyl methylcellulose, hydroxyethyl cellulose, hydroxypropyl cellulose and methylcellulose; polyvinyl alcohol; and polyvinyl pyrrolidone. Such additives, when present, may be used in a wide range of concentrations, generally about 0.1 to about 10 weight percent.

Contact lenses are treated with the compositions by contacting the lenses with the compositions. For example, a contact lens can be stored in the solution, or soaked in the solution, for sufficient time to wet the surfaces thereof. The treated lens can be inserted directly in the eye, or alternately, the lens can be rinsed. Alternately, drops of solution can be placed on the lens surface and the treated lens inserted in the eye. The specific lens care regimen used will depend on the other compounds present in the solution, as is well known in the art.

For compositions containing an antimicrobial agent, the contact lens is preferably soaked in the composition for sufficient time to disinfect the lens and wet the surface thereof.

According to a further embodiment of the invention, the compositions may include at least one surface active agent having cleaning activity for contact lens deposits in order to provide contact lens solutions useful for cleaning and wetting contact lenses. A wide variety of surface active agents are known in the art as a primary cleaning agent, including anionic, cationic, nonionic. and amphoteric surface active agents. Representative surface active agents are included in the Examples, infra. The surface active agents having cleaning activity for contact lens deposits may be employed at about 0.001 to about 5 weight percent of the composition, preferably at about 0.005 to about 2 weight percent, with about 0.01 to about 0.1 weight percent being especially preferred.

The following examples further illustrate preferred embodiments of the invention.

Components used in the following Examples are listed below. The list includes (in each case, if available) a generic description of the component, the corresponding identification adopted by the Cosmetic, Toiletry, and Fragrance Association (CTFA), and the tradename and source of the component used.

Alkylaryl polyether alcohol
Octoxynol-9 (CTFA)
Triton X-100® (Rohm and Haas Co., Inc. Philadelphia, Pa.)

Cocamidopropyl Betaine (CTFA)
Monateric CAB® (Mona Industries Inc., Paterson, N.J.)

Lauroamphoglycinate
Sodium Laruoamphoacetate (CTFA)
Monateric LM-M30® (Mona Industries Inc., Paterson, N.J.)

Cocoamphocarboxylglycinate
Disodium Cocoamphodiacetate (CTFA)
Monateric CSH-32® (Mona Industries Inc., Paterson, N.J.)

Isostearoamphopropionate
Sodium Isostearoamphopropionate (CTFA) Monateric ISA-35® (Mona Industries Inc., Paterson, N.J.)
Cocoamphopropylsulfonate
Sodium Cocoamphohydroxypropylsulfonate (CTFA)
Miranol CS® COnc. (Rhone-Poulenc Inc., Cranbury, N.J.)

Lauryl ester of sorbito
Polysorbate 20® )CTFA)
Tween 20 (ICI Americas, Inc., Wilmington, Del.)

Sodium Tridecy Ether Sulfate

Sodium Trideceth Sulfate (CTFA)
SIPEX EST-30 ® (Rhone-Poulenc, Inc., Cranbury, N.J.)

Polyoxyethylene, Polyoxypropylene Block Polymer
Poloxamer 235 (CTFA)
P;uronic P-85 ® (BASF Corp., Parsippany, N.J.)

Modified Cellulose Polymer
Hydroxyethylcellulose (CTFA)
Natrosol 250MR ® (Aqualon Co., Wilmington, Del.)

Modified Cellulose Polymer
Hydroxypropylmethycellulose (CTFA)
Methocel E4M ® (Dow Chemical, Midland, Mich.)

Cationic Ethoxylatedf Glucose Derivative
Lauryl Methyl Gluceth-10
Hydroxypropyldimonium Chloride (CTFA)
Glucquat-100 ® (Amerchol Corp., Edison, N.J.)

Hydrolyzed Polyvinylacetate
Polyvinyl Alcohol (CTFA)
Vinol 107 ® (Air Products Chemicals, Inc., Allentown, Pa.)

Polyoxyethylene, Polyoxypropylene Block Polymer
Poloxamer 407 (CTFA)
Pluronic F-127 ® (BASF Corp., Parsippany, N.J.)

Ethoxylated glycerol derivative
Glycereth-26 (CTFA)
Liponic EG-1 ® (Lipo Chemicals, Inc., Paterson, N.J.)

Ethoxylated glycerol derivative
Glycereth-26 (CTFA)
Ethosperse G26 ® (Lonza Inc., Pairlawn, N.J.)

Ehoxylated sorbitol derivative
Sorbweth-20 (CTFA)
Ethosperse SL-20 ® (Lonza Inc., Fairlawn, N.J.)

Ethoxylated Gluceth-20 (CTFA)
Glucam E-20 ® (Amerchol Corp., Edison, N.J.)

Sample materials for surface analyses in the Examples were prepared from standard contact lens blanks. Wafers with a diameter of 12.7 mm and a thickness of 0.25 mm were cut from the blanks and both surfaces polished to an optical finish using a polishing powder dispersed in deionized water. Polished samples were rinsed thoroughly with deionized water and stored in a clean glass vial under deionized water until use.

Dynamic contact angle measurements were made with hydrated, polished wafers utilizing a Cahn Instruments DCA 322. Wafers were dipped in the test solution 7 times at an average rate of 225 microns per second. All tests were run at room temperature. A computer assisted mathematical analysis of the data yields a graph of contact angle plotted against the vertical position on the wafer. The average Advancing and Receding contact angles were obtained from the graph.

The surface tension of solution samples is determined with a Cahn Instruments DCA 322. Glass slides measuring 25 mm×30 mm×0.14 mm are flame cleaned and then dipped into the test solution 7 times at an average rate of 225 microns per second. All tests were run at room temperature. A computer assisted mathematical analysis of the data yields a graph of force versus position on the glass slide. The surface tension is obtained from this graph.

EXAMPLE 1

Solutions containing the following ingredients were prepared and passed through a 0.22 micron sterilizing filter in a clean room environment. The solutions were then packaged in sterile bottles.

| | Solution | | | | | |
|---|---|---|---|---|---|---|
| Ingredients | A | B | C | D | E | F |
| Glucquat 100, % | | 0.100 | 0.200 | 0.300 | 0.400 | 0.500 |
| Sodium Borate, % | 0.070 | 0.070 | 0.070 | 0.070 | 0.070 | 0.070 |
| Boric Acid % | 0.450 | 0.450 | 0.450 | 0.450 | 0.450 | 0.450 |
| Sodium % | 0.700 | 0.700 | 0.700 | 0.700 | 0.700 | 0.700 |
| Potassium Chloride % | 0.150 | 0.150 | 0.150 | 0.150 | 0.150 | 0.150 |
| Disodium Edetate % | 0.050 | 0.050 | 0.050 | 0.050 | 0.050 | 0.050 |
| Polyhexamethylene Biguanide, ppm | 15 | 15 | 15 | 15 | 15 | 15 |
| Deionized Water Q.S. % | 100 | 100 | 100 | 100 | 100 | 100 |

The solutions described above were evaluated in-eye to assess the clinical impact of various concentrations of GLUCQUAT 100 in borate buffer. Eyes were examined using fluorescein instillation and biomicroscopy. Baselines on both eyes were established prior to instillation of any solutions. After instillation of two drops of test solution the eyes were examined again. The FDA classification of slit lamp findings was utilized to classify any corneal staining. Additionally, the individuals were asked to comment on the comfort of the test solutions.

Solution A, the control produced no corneal staining and was perceived as "comfortable" by the test subjects. Solutions B through F produced the same results as the control, namely, no staining and no adverse effect on comfort. These results indicate that GLUCQUAT 100 is well tolerated in the ocular environment.

EXAMPLE 2

A fluorosilicone rigid gas permeable (RGP) contact lens material (BOSTON RXD ®, Polymer Technology Corporation, Boston, Mass.) was cut into wafers and both sides were polished to an optical finish. Dynamic contact angles (DCA) were determined for the RGP material in various solutions described in TABLE 1. The DCA results are presented in TABLE 2.

TABLE 1

| | Solution | | | |
|---|---|---|---|---|
| | A | B | C | D |
| Glucquat 100 % | | 0.100 | 0.010 | 0.001 |
| Sodium Phosphate, dibasic % | 0.280 | 0.280 | 0.280 | 0.280 |

TABLE 1-continued

| | Solution | | | |
|---|---|---|---|---|
| | A | B | C | D |
| Potassium Phosphate, monobasic % | 0.055 | 0.055 | 0.055 | 0.055 |
| Sodium Chloride % | 0.780 | 0.780 | 0.780 | 0.780 |
| Potassium Chloride % | 0.170 | 0.170 | 0.170 | 0.170 |
| Disodium Edetate % | 0.050 | 0.050 | 0.050 | 0.050 |
| LDeionized Water Q.S. % | 100 | 100 | 100 | 100 |

TABLE 2

| | Solution | | | |
|---|---|---|---|---|
| | A Control | B 0.1% Glucquat 100 | C 0.01% Glucquat 100 | D 0.001% Glucquat 100 |
| S.T. | 73.8 | 32.9 | 43.9 | 66.8 |
| Adv $\phi$ | 98 | 20 | 27 | 89 |
| Rec $\phi$ | 30 | 18 | 24 | 27 |
| Adv-Rec | 68 | 2 | 3 | 62 |

S.T. = Surface Tension (dynes/cm)
Adv. = Advancing contact angle in degrees
Rec = Receding contact angle in degrees
Adv-Rec = Difference between advancing and receding contact angles It is evident from the lowering of the surface tension that GLUCQUAT is very surface active, even at low concentrations. At concentrations above 0.01% GLUCQUAT 100 dramatically lowers both the advancing and receding contact angles of the RGP material. The low hysteresis (Adv-Rec) suggests a strong adsorption of the GLUCQUAT on the surface of the lens material.

EXAMPLE 3

The formulations of this example are representative of conditioning solutions for contact lenses which provide disinfection and cushioning of the lens surface.

The hydroxypropyl methylcellulose (HPMC), sodium chloride, potassium chloride, and disodium edetate were dissolved in deionized water, then autoclaved at 121° C. for 30–40 minutes. The solution was then transferred to a clean room where the remaining ingredients, dissolved in deionized water, were added to the solution through a 0.22 micron filter. The final solution was mixed and dispensed to sterile bottles.

| | Solution | | | | |
|---|---|---|---|---|---|
| | A | B | C | D | B |
| Ingredients | | | | | |
| HPMC E4M | 0.500 | 0.500 | 0.500 | 0.500 | 0.500 |
| Glucam E-20 % | 0.200 | 0.200 | 0.200 | 0.200 | 0.200 |
| Glucquat 100 % | 0.100 | 0.200 | 0.300 | 0.400 | 0.500 |
| Sodium Phosphate, dibasic % | 0.280 | 0.280 | 0.280 | 0.280 | 0.280 |
| Potassium Phosphate, monobasic % | 0.055 | 0.055 | 0.055 | 0.055 | 0.055 |
| Sodium Chloride % | 0.780 | 0.780 | 0.780 | 0.780 | 0.780 |
| Potassium Chloride % | 0.170 | 0.170 | 0.170 | 0.170 | 0.170 |
| Disodium Edetate % | 0.050 | 0.050 | 0.050 | 0.050 | 0.050 |
| Polyhexamethylene Biguanide, ppm | 15 | 15 | 15 | 15 | 15 |
| Deionized Water Q.S. % | 100 | 100 | 100 | 100 | 100 |
| Physical Properties | | | | | |
| Viscosity (cps) | 19.5 | 19.5 | 19.5 | 20.0 | 20.0 |
| pH | 7.23 | 7.23 | 7.24 | 7.23 | 7.23 |
| Osmolality (mOsm/kg) | 355 | 359 | 362 | 366 | 367 |
| Surface Tension (dynes/cm) | 39.3 | 38.5 | 38.5 | 38.1 | 38.1 |

EXAMPLE 4

The solutions described in EXAMPLE 3 were evaluated on eye to assess the clinical performance of conditioning solutions containing GLUCQUAT 100 at various concentrations. Clean BOSTON RXD lenses for two adapted RGP lens wearers were soaked in the solutions overnight. Each subject installed the lenses directly from the solution (no rinse step) and was examined immediately by a clinician who evaluated a number of parameters using a biomicroscope. The compiled results of the clinical evaluation of solutions A through E are presented below.

| | TBUT* (sec) | WETTING | TEAR FILM QUALITY |
|---|---|---|---|
| A | >15 | All solutions provided a conditioned lens surface which was 100% wet by the tear film. | All solutions provided a conditioned lens surface which supported a very even tear film layer. |
| B | >15 | | |
| C | >15 | | |
| D | >15 | | |
| E | >15 | | |

*Tear Break-up Time

All solutions provided a conditioned lens surface which exhibited excellent ocular compatibility. The tear film wetted the entire surface of the lens and was even in nature. The quality of the tear film on the conditioned lens surface was such that very long tear break up times, greater than 15 seconds were observed.

EXAMPLE 5

The formulations of this example are representative of conditioning solutions containing a polyethylene oxide-containing polymer for increased biocompatibility.

The HPMC, polyvinyl alcohol, sodium chloride, potassium chloride and disodium edetate were dissolved in deionized water, then autoclaved at 121° C. for 30–40 minutes. The solution was then transferred to a clean room where the remaining ingredients, dissolved in deionized water, were added to the solution through a 0.22 micron filter. The final solution was mixed and dispensed to sterile bottles.

| | Solution | | | |
|---|---|---|---|---|
| | A | B | C | D |
| Ingredients | | | | |
| HPMC E4M % | 0.500 | 0.500 | 0.500 | 0.500 |
| PVA 107, % | 0.300 | 0.300 | 0.300 | 0.300 |
| Glucquat 100 % | 0.050 | 0.050 | 0.050 | 0.050 |
| Glucam E-20 % | 0.200 | | | |
| Liponic EG-1 % | | 0.200 | | |
| Ethosperse SL-20 % | | | 0.200 | |
| Ethosperse G-26 % | | | | 0.200 |
| Sodium Phosphate, dibasic % | 0.280 | 0.280 | 0.280 | 0.280 |
| Potassium Phosphate, monobasic % | 0.055 | 0.055 | 0.055 | 0.055 |
| Sodium Chloride % | 0.780 | 0.780 | 0.780 | 0.780 |
| Potassium Chloride % | 0.170 | 0.170 | 0.170 | 0.170 |
| Disodium Edetate % | 0.050 | 0.050 | 0.050 | 0.050 |
| Polyhexamethylene | 15 | 15 | 15 | 15 |

-continued

| | Solution | | | |
|---|---|---|---|---|
| | A | B | C | D |
| Biguanide, ppm | | | | |
| Deionized Water Q.S. % | 100 | 100 | 100 | 100 |
| Physical Properties | | | | |
| Viscosity (cps) | 24.9 | 24.1 | 25.2 | 25.0 |
| pH | 7.21 | 7.19 | 7.22 | 7.20 |
| Osmolality (mOsm/kg) | 366 | 367 | 370 | 369 |
| Surface Tension (dynes/cm) | 43.3 | 42.0 | 42.9 | 43.0 |

EXAMPLE 6

The conditioning solutions described in EXAMPLE 5 were evaluated on eye to assess clinical performance. Clean BOSTON RXD lenses for two adapted RGP lens wearers were soaked in the solutions overnight. Each subject installed the lenses directly from the solution (no rinse step) and was examined immediately by a clinician who evaluated a number of parameters using a biomicroscope. The compiled results of the clinical evaluation of solutions A through D are presented below.

| | TBUT* (sec) QUALITY | WETTING | TEAR FILM |
|---|---|---|---|
| A | >15 | All solutions provided a conditioned lens surface which was 100% wet by the tear film. | All solutions provided a conditioned lens surface which supported a very even tear film layer. |
| B | >15 | | |
| C | >15 | | |
| D | >15 | | |

*Tear Break-up Time

All solutions provided conditioned contact lenses surfaces which exhibited excellent ocular compatibility. The tear film evenly wetted the entire lens surface. The quality of the tear film was evidenced by the long tear break up time of greater than 15 seconds.

EXAMPLE 7

The formulations of this example are representative of conditioning solutions for contact lenses which provide disinfection and cushioning of the lens surface.

The HPMC, hydroxyethylcellulose (HEC), polyvinyl alcohol, sodium chloride, potassium chloride, and disodium edetate were dissolved in deionized water, then autoclaved at 121° C. for 30–40 minutes. The solution was then transferred to a clean room where the remaining ingredients, dissolved in deionized water, were added to the solution through a 0.22 micron filter. The final solution was mixed and dispensed to sterile bottles.

| | Solution | | | |
|---|---|---|---|---|
| | A | B | C | D |
| Ingredients | | | | |
| Glucquat 100, % | 0.100 | 0.100 | 0.100 | 0.100 |
| HPMC E4M | 0.500 | 0.500 | | |
| HEC 250MR, % | | | 0.500 | 0.500 |
| PVA, 107 % | | 0.300 | | 0.300 |
| Pluronic F-127 % | 0.300 | | 0.300 | |
| Sodium Phosphate, dibasic % | 0.280 | 0.280 | 0.280 | 0.280 |
| Potassium Phosphate, monobasic % | 0.055 | 0.055 | 0.055 | 0.055 |

-continued

| | Solution | | | |
|---|---|---|---|---|
| | A | B | C | D |
| Sodium Chloride % | 0.780 | 0.780 | 0.780 | 0.780 |
| Potassium Chloride % | 0.170 | 0.170 | 0.170 | 0.170 |
| Disodium Edetate % | 0.050 | 0.050 | 0.050 | 0.050 |
| Polyhexamethylene Biguanide, ppm | 15 | 15 | 15 | 15 |
| Deionized Water Q.S % | 100 | 100 | 100 | 100 |
| Physical Properties | | | | |
| Viscosity (cps) | 22.0 | 24.5 | 12.2 | 14.2 |
| pH | 7.18 | 7.23 | 7.30 | 7.10 |
| Osmolality (mOsm/kg) | 352 | 366 | 369 | 371 |
| Surface Tension (dynes/cm) | 38.2 | 41.2 | 38.3 | 41.4 |

EXAMPLE 8

The solutions described in EXAMPLE 7 were evaluated on eye to assess the clinical performance. Clean BOSTON RXD lenses for two adapted RGP lens wearers were soaked in the solutions overnight. Each subject installed the lenses directly from the solution (no rinse step) and was examined immediately by a clinician who evaluated a number of parameters using a biomicroscope.

The compiled results of the clinical evaluation of solutions A through D are presented below.

| | TBUT* (sec) | WETTING | TEAR FILM QUALITY |
|---|---|---|---|
| A | >15 | All solutions provided a conditioned lens surface which was 100% wet by the tear film. | All solutions provided a conditioned lens surface which supported a very even tear film layer. |
| B | >15 | | |
| C | >15 | | |
| D | >15 | | |

*Tear Break-up Time

All solutions produced conditioned contact lens surfaces which provided excellent ocular compatibilities. The tear film evenly wetted the entire lens surface. Tear break up times of greater than 15 seconds were observed indicating a tenacious tear film on the lens surface.

EXAMPLE 9

The formulations of this example are representative of multipurpose contact lens solutions which clean, disinfect and condition the surfaces of contact lenses in one step.

Solutions containing the following ingredients were prepared and passed through a 0.22 micron sterilizing filter in a clean room environment. The solutions were then packaged in sterile bottles.

| | Solution | | | | | |
|---|---|---|---|---|---|---|
| | A | B | C | D | E | F |
| Ingredients | | | | | | |
| Glycerin U.S.P. % | 2.000 | 2.000 | 2.000 | 2.000 | 2.000 | 2.000 |
| Pluronic P-85 % | 1.000 | 1.000 | 0.800 | 0.800 | 0.500 | 0.500 |
| Glucquat 100, % | 0.300 | 0.200 | 0.400 | 0.300 | 0.400 | 0.300 |
| Sodium Borate % | 0.070 | 0.070 | 0.070 | 0.070 | 0.070 | 0.070 |
| Boric Acid % | 0.450 | 0.450 | 0.450 | 0.450 | 0.450 | 0.450 |
| Sodium | 0.700 | 0.700 | 0.700 | 0.700 | 0.700 | 0.700 |

-continued

| | Solution | | | | | |
|---|---|---|---|---|---|---|
| | A | B | C | D | E | F |
| Chloride % | | | | | | |
| Potassium Chloride % | 0.150 | 0.150 | 0.150 | 0.150 | 0.150 | 0.150 |
| Disodium Edetate % | 0.050 | 0.050 | 0.050 | 0.050 | 0.050 | 0.050 |
| Polyhexamethylene Biguanide, ppm | 15 | 15 | 15 | 15 | 15 | 15 |
| Deionized Water Q.S. % | 100 | 100 | 100 | 100 | 100 | 100 |
| Physical Properties | | | | | | |
| Viscosity (cps) | 1.6 | 1.6 | 1.5 | 1.5 | 1.8 | 1.3 |
| pH | 6.57 | 6.54 | 6.55 | 6.51 | 6.53 | 6.56 |
| Osmolality (mOsm/kg) | 595 | 588 | 584 | 582 | 579 | 571 |
| Surface Tension (dynes/cm) | 34.2 | 34.8 | 34.7 | 34.6 | 34.4 | 34.3 |

EXAMPLE 10

The solutions described in EXAMPLE 9 were evaluated in-eye to assess the clinical impact of various concentrations of GLUCQUAT 100 and PLURONIC P-85 in borate buffer. Eyes were examined using fluorescein instillation and biomicroscopy at baseline and immediately after instillation of two drops of test solution. The FDA classification of slit lamp findings was utilized to classify any corneal staining. Additionally, the individuals were asked to comment on the comfort of the test solutions.

None of the solutions produced corneal staining and all were perceived as "comfortable" by the test subjects.

EXAMPLE 11

The solutions of EXAMPLE 9 were evaluated to determine the cleaning efficacy in removing contact lens deposits during the soaking period.

BOSTON RXD lenses were worn by adapted RGP lens wearers for 12 to 16 hours. At that time lenses were removed from the eyes and placed in contact lens cases. The lenses were kept dry until use in the cleaning efficacy test.

The worn lenses were examined using a microscope at 20X magnification and the deposit pattern noted. A lens was then placed in a contact lens storage case and about 1 ml of the test solution was added to cover the lens completely with the fluid. The case was closed and allowed to stand at ambient conditions for 12 hours. At that time the lens was removed and rubbed between the forefinger and the thumb for about 20 seconds. The lens was then rinsed thoroughly with water and dried with compressed air. The dried lens was again examined at 20X magnification to identify the extent of deposit removal. Results are shown below.

| Solution | % deposit removed |
|---|---|
| A | 99 |
| B | 99 |
| C | 98 |
| D | 97 |
| E | 97 |

-continued

| Solution | % deposit removed |
|---|---|
| F | 95 |

EXAMPLE 12

The formulations of this example are representative of multipurpose solutions which clean, disinfect, and condition the surfaces of contact lenses in one step.

Solutions containing the following ingredients were prepared and passed through a 0.22 micron sterilizing filter in a clean room environment. The solutions were then packaged in sterile bottles.

| | Solutions | | | | |
|---|---|---|---|---|---|
| | A | B | C | D | B |
| Ingredients | | | | | |
| Glucquat 100 % | 0.100 | 0.100 | 0.100 | 0.100 | 0.100 |
| Glycerin-U.S.P % | 2.000 | 2.009 | 2.000 | 2.000 | 2.000 |
| Tween 20 % | 0.100 | 0.100 | 0.100 | 0.100 | 0.100 |
| Sipex EST-30 % | | 0.100 | | | |
| Monateric CSH-32 % | | | 0.100 | | 0.100 |
| Monateric ISA-35 % | | | | 0.100 | 0.100 |
| Sodium Borate % | 0.070 | 0.070 | 0.070 | 0.070 | 0.070 |
| Boric Acid % | 0.450 | 0.450 | 0.450 | 0.450 | 0.450 |
| Sodium Chloride % | 0.700 | 0.700 | 0.700 | 0.700 | 0.700 |
| Potassium Chloride % | 0.150 | 0.150 | 0.150 | 0.150 | 0.150 |
| Disodium Edetate % | 0.050 | 0.050 | 0.050 | 0.050 | 0.050 |
| Polyhexamethylene Biguanide, ppm | 15 | 15 | 15 | 15 | 15 |
| Deionized Water Q.S. % | 100 | 100 | 100 | 100 | 100 |
| Physical Properties | | | | | |
| Viscosity (cps) | 1.3 | 1.5 | 1.8 | 2.0 | 1.4 |
| pH | 6.55 | 6.55 | 6.59 | 6.53 | 6.59 |
| Osmolality (mOsm/kg) | 575 | 575 | 580 | 576 | 580 |
| Surface Tension (dynes/cm) | 36.1 | 27.7 | 32.4 | 32.4 | 30.2 |

EXAMPLE 13

The solutions described in EXAMPLE 12 were evaluated in-eye to assess the clinical impact of GLUCQUAT 100 with various non-ionic, anionic and amphoteric surfactants in borate buffer. Eyes were examined using fluorescein instillation and biomicroscopy at baseline and immediately after instillation of two drops of test solution. The FDA classification of slit lamp findings was utilized to classify any corneal staining. Additionally, the individuals were asked to comment on the comfort of the test solutions.

None of the solutions produced corneal staining and all were perceived as "comfortable" by the test subjects.

EXAMPLE 14

The solutions of EXAMPLE 12 were evaluated to determine their cleaning efficacy in removing contact lens deposits during the soaking period.

BOSTON RXD lenses were worn by adapted RGP lens wearers for 12 to 16 hours. At that time lenses were removed from the eyes and placed in contact lens cases. The lenses were kept dry until use in the cleaning efficacy test.

The worn lenses were examined using a microscope at 20X magnification and the deposit pattern was noted. A lens was then placed in a contact lens storage case and about 1 ml of the test solution added to cover the lens completely with the fluid. The case was closed and allowed to stand at ambient conditions for 12 hours. At that time the lens was removed and rubbed between the forefinger and the thumb for about 20 seconds. The lens was then rinsed thoroughly with water and dried with compressed air. The dried lens was again examined at 20X magnification to identify the extent of deposit removal.

Results are shown below.

| Solution | % deposit removed |
|---|---|
| A | 96 |
| B | 99 |
| C | 97 |
| D | 97 |
| E | 98 |

EXAMPLE 15

The formulations of this example are representative of alcohol-containing cleaning solutions for contact lenses.

Cleaning solutions containing the following ingredients were prepared and bottled.

| | Solution | | | | | |
|---|---|---|---|---|---|---|
| | A | B | C | D | E | F |
| Ingredients | | | | | | |
| Glucquat 100 % | 1.000 | 1.000 | 1.000 | 1.000 | 1.000 | 1.000 |
| Triton X-100 % | 2.000 | | | | | |
| Monateric CAB % | | 6.670 | | | | |
| Monateric LMM-30 % | | | 6.670 | | | |
| Monateric CSH-32 % | | | | 6.250 | | |
| Monateric ISA 35 % | | | | | 5.720 | |
| Miranol CS Conc % | | | | | | 4.450 |
| Isopropyl Alcohol % | 20.0 | 20.0 | 20.0 | 20.0 | 20.0 | 20.0 |
| Deionized Water Q.S. % | 100 | 100 | 100 | 100 | 100 | 100 |
| Physical Properties | | | | | | |
| pH | 6.22 | 6.15 | 8.56 | 7.92 | 5.91 | 7.97 |
| Surface Tension (dynes/cm) | 26.0 | 26.0 | 28.2 | 27.5 | 28.5 | 28.8 |

EXAMPLE 16

The solutions in EXAMPLE 15 were evaluated to determine the cleaning efficacy.

BOSTON RXD lenses were worn by adapted RGP lens wearers for 12 to 15 hours. At that time lenses were removed from the eyes and placed in contact lens cases. The lenses were kept dry until use in the cleaning efficacy test.

The worn lenses were examined using a microscope at 20X magnification and the deposit pattern noted. A lens was then placed in the palm of the hand and several drops of test solution were added. Using the forefinger, the lens was then rubbed in the palm of the hand for 20 seconds. A few more drops of test solution were added and the procedure repeated. The lens was then rinsed thoroughly with water and dried with compressed air. The dried lens was again examined at 20X magnification to identify the extent of deposit removal.

Results are shown below. Each of the solutions was effective in removing deposits from worn contact lenses.

| Solution | % deposit removed |
|---|---|
| A | 98 |
| B | 99 |
| C | 97 |
| D | 97 |
| E | 97 |
| F | 98 |

We claim:

1. A method of wetting a contact lens comprising contacting said contact lens with an aqueous composition which comprises a quaternary nitrogen-containing ethoxylated alkyl glucoside.

2. The method of claim 1, wherein the quaternary nitrogen-containing ethoxylated alkyl glucoside is represented by the formula:

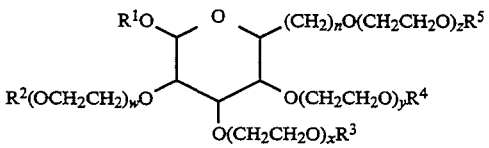

wherein $R^1$ is alkyl; the average sum of w, x, y, and z per mole of compound is within the range of about 1 to about 200; $R^2$, $R^3$, $R^4$, and $R^5$ are individually hydrogen or quaternary nitrogen-containing groups; provided that at least one $R^2$, $R^3$, $R^4$, or $R^5$ is a quaternary nitrogen-containing group and that at least one $R^2$, $R^3$, $R^4$, or $R^5$ is hydrogen.

3. The method of claim 1 wherein the quaternary nitrogen-containing ethoxylated alkyl glucoside is lauryl methyl gluceth-10 hydroxypropyldimonium chloride.

4. The method of claim 1, wherein the composition further comprises at least one member selected from the group consisting of buffering agents and tonicity adjusting agents.

5. A method of disinfecting and wetting a contact lens comprising contacting said contact lens with an aqueous composition which comprises a quaternary nitrogen-containing ethoxylated alkyl glucoside and an antimicrobially effective amount of an antimicrobial agent.

6. The method of claim 1, wherein the contact lens is a rigid, gas permeable contact lens.

7. The method of claim 6, wherein surfaces of the lens are negatively charged.

8. The method of claim 1, further comprising inserting the contact lens directly in the eye.

9. The method of claim 5, wherein the contact lens is a rigid, gas permeable contact lens.

10. The method of claim 9, wherein surfaces of the lens are negatively charged.

11. The method of claim 5, further comprising inserting the contact lens directly in the eye.

* * * * *

UNITED STATES PATENT AND TRADEMARK OFFICE

CERTIFICATE OF CORRECTION

PATENT NO. : 5,405,878

DATED : Apr. 11, 1995

INVENTOR(S) : Edward J. Ellis, et al

It is certified that error appears in the above-indentified patent and that said Letters Patent is hereby corrected as shown below:

In column 4, line 60, change "COnc." to -- Conc. --.

In column 4, line 64, change ")CTFA)" to -- (CTFA) --.

Column 4, line 68, change "Tridecy" to --Tridecyl--.

In column 5, line 7, change "P;uronic" to -- Pluronic --.

In column 5, line 20, change "Ethoxylatedf" to -- Ethoxylated --.

In column 5, line 44, change "Pairlawn" to -- Fairlawn --.

In column 5, line 46, change "Ehoxylated" to -- Ethoxylated --.

In column 5, line 47, change "Sorbweth" to -- Sorbeth --.

UNITED STATES PATENT AND TRADEMARK OFFICE

CERTIFICATE OF CORRECTION

PATENT NO. : 5,405,878

DATED : Apr. 11, 1995

INVENTOR(S) : Edward J. Ellis, et al

It is certified that error appears in the above-indentified patent and that said Letters Patent is hereby corrected as shown below:

In column 5, lines 51-53, change to read as follows:

Ethoxylated glucose derivative
Methyl Gluceth-20 (CTFA)
Glucam E-20® (Amerchol Corp.,
Edison, N.J.)

In column 7, line 9, change "LDeionized" to -- Deionized --.

In column 7, line 50, change the heading of the last column from "B" to -- E --.

In column 8, line 3, change the heading of the last column from "B" to -- E --.

In column 12, line 18, change the heading of the last column from "B" to -- E --.

In column 12, line 21, change "2.009" to -- 2.000 --.

In column 12, line 37, change the second occurrence of "32.4" to -- 32.0 --.

Signed and Sealed this

Seventh Day of November, 1995

Bruce Lehman

*Attest:*

BRUCE LEHMAN

*Attesting Officer*

*Commissioner of Patents and Trademarks*